US005420765A

United States Patent [19]

Nordeen et al.

[11] Patent Number: 5,420,765

[45] Date of Patent: May 30, 1995

[54] LIGHTING ORNAMENT

[76] Inventors: Peter Nordeen, 5647 Harper's Farm Rd., Columbia, Md. 21044; Carl C. Lienau, 303 W. 66th St., New York City, N.Y. 10023

[21] Appl. No.: 176,714

[22] Filed: Jan. 3, 1994

[51] Int. Cl.[6] ..... F21V 7/04

[52] U.S. Cl. ..... 362/96; 362/123

[58] Field of Search ..... 362/96, 123, 318, 811, 362/806, 293, 373, 101, 122

[56] References Cited

U.S. PATENT DOCUMENTS

| | | | |
|---|---|---|---|
| 3,536,908 | 10/1970 | Oster | 362/123 |
| 3,564,233 | 2/1971 | Cox et al. | 362/123 |
| 3,766,376 | 10/1973 | Sadacca | 362/123 |
| 3,995,151 | 11/1976 | Nordeen et al. | 362/96 |
| 4,170,035 | 10/1979 | Walker | 362/96 |
| 4,190,312 | 2/1980 | Bailey | 362/96 |

*Primary Examiner*—Ira S. Lazarus

*Assistant Examiner*—Daniel J. O'Connor

*Attorney, Agent, or Firm*—Morris I. Pollack

[57] ABSTRACT

Tubular members of predetermined lengths are arranged in ornamental fashion, such as a helix disposed in a conical or cylindrical configuration or as a festooned member, and are adapted to contain a first fluid, such as water, and to receive a second fluid, such as air, which is lighter than water and which passes through the first fluid in pockets separated one from the other. The wall of the tubular members transmits light its entire length which when illuminated coacts with the first fluid and the second fluid, as it passes through the first fluid, to provide a pleasingly aesthetic affect. A conduit member may also be carried by said tubular members to act as a return for the second fluid; and suitable pump means are provided to inject said second fluid into said first fluid. If desired, particles of reflecting material may be disposed in said first fluid, and the light may be of single or changing colors.

20 Claims, 3 Drawing Sheets

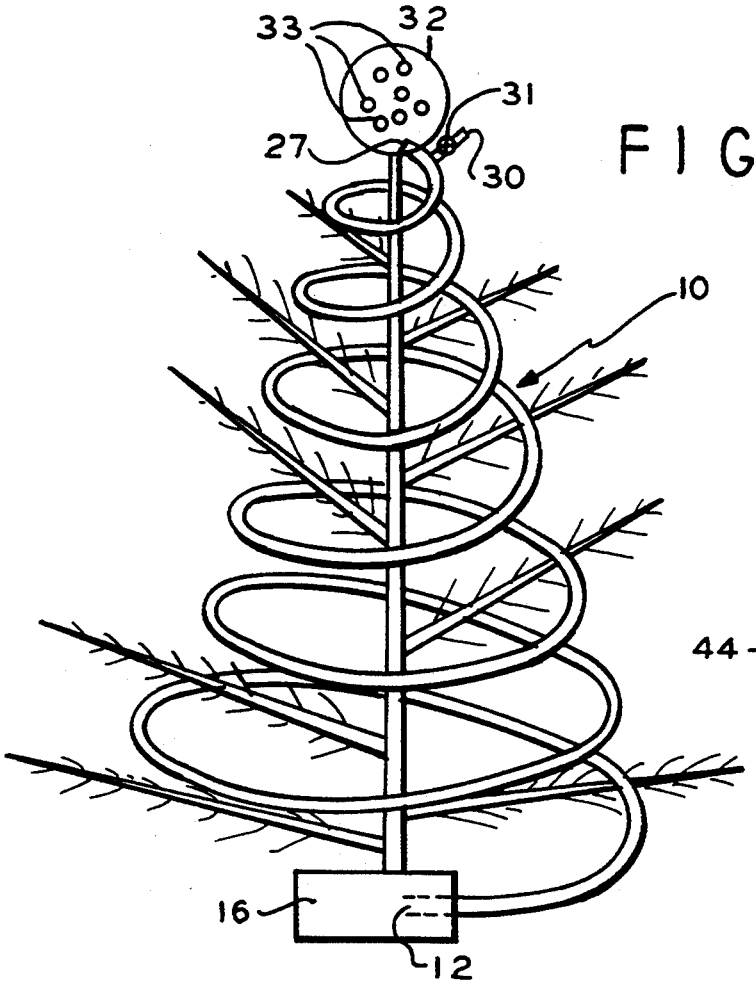
FIG. 1
FIG. 4
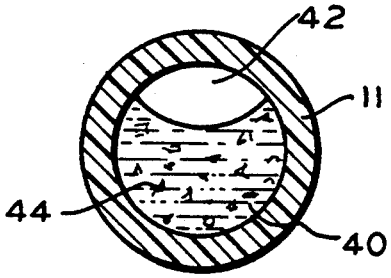
FIG. 2
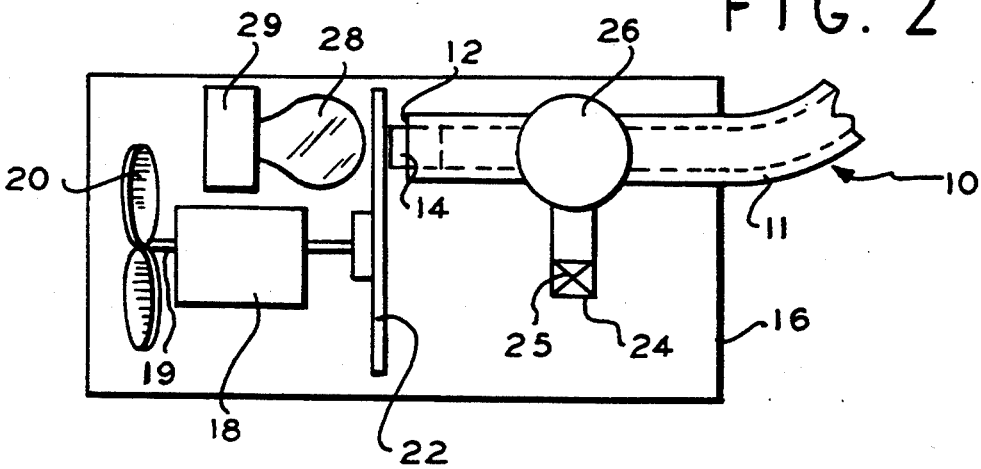
FIG. 3
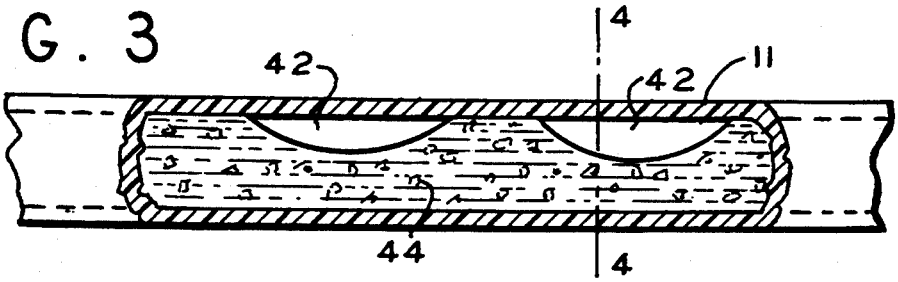

LIGHTING ORNAMENT

BACKGROUND OF THE INVENTION-FIELD OF APPLICATION

This invention relates to lighting ornaments, and more particularly to a lighting ornament which contains a first fluid and receives a second fluid which passes through said first fluid in pockets separated one from the other.

BACKGROUND OF THE INVENTION-DESCRIPTION OF THE PRIOR ART

Lighting ornaments are presently known wherein air is bubbled through a liquid in tubular and other containers, and wherein the coaction of the air bubbling through the liquid is illuminated for the aesthetic affect thus obtained. Devices such as those shown in U.S. Pat. No. 1,853,311 granted to A.K. Krakau on Dec. 8, 1931 for Electrical Advertising Apparatus, and in U.S. Letters Pat. No. 3,058,245 granted to S.D. Pieters on Oct. 16, 1962 for Luminous Advertising and Display Means are quite typical. However, these devices are cumbersome to handle. My earlier Patent, U.S. Letters Pat. No. 3,995,151 Lighting Ornament, while a significant improvement over those listed above required the stringing of electrical lights along the length of the device in order to provide for illumination. This creates a potential safety problem, and otherwise presents a higher relative cost.

SUMMARY OF THE INVENTION

It is therefore an object of this invention to provide a novel and improved lighting ornament.

It is another object of this invention to provide a novel and improved lighting ornament incorporating first and second coacting fluids.

It is still another object of this invention to provide a novel and improved lighting ornament wherein a tubular member is adapted to receive first and second coacting fluids and is further adapted to be arranged in an ornamental configuration.

Yet still a further object of this invention is to provide a novel and improved lighting ornament wherein a tubular member, adapted to receive first and second coacting fluids and to be arranged in an ornamental configuration, has light transmitted within its wall.

Yet still another object of this invention is to provide a novel and improved lighting ornament wherein a tubular member with the ability to transmit light within its wall is adapted to receive first and second coacting fluids and to be arranged either as a helix in conical or cylindrical configuration or to be festooned carries a conduit member to provide a closed path for said second fluid as it moves out of said first fluid and back into said first fluid.

Still yet an additional object of this invention is to provide a novel and improved lighting ornament adapted to receive first and second coacting fluids and to be arranged in an ornamented configuration with light transmitted within its wall, wherein a light source is disposed externally of and proximate to a first end of said tubular member and a coloring means may be provided for said light source.

Further still yet another object of this invention is to provide a novel and improved lighting ornament adapted to receive two coacting fluids and to be arranged in an ornamental configuration with light transmitted within its wall wherein a second end of said tubular member is terminated within an ending means of decorative or ornamental design.

In carrying out the invention, according to the preferred embodiment thereof, a translucent light conducting tubular member is formed into an ornamental configuration and so as to receive a first fluid, such as water, which may have coloring added thereto. A second fluid, such as air, is pumped into said first fluid and passes in pockets through said first fluid. Illuminating means are provided for said tubular means while conduit means may also be provided for providing a closed loop to retain the second fluid in the system.

Other objects, features, and advantages of the invention in its details of construction and arrangement of parts, will be seen from the above, from the following description of the preferred embodiment when considered in conjunction with the drawings and from the appended claims.

BRIEF DESCRIPTION OF THE DRAWINGS

In the drawing:

FIG. 1 is an elevational view of an embodiment of a lighting ornament, incorporating the instant invention, in a helix of conical configuration as a Christmas tree ornament;

FIG. 2 is a schematic of an external light source, coloring means, pump and fan disposed proximate a first end of a light transmitting tubular member of the instant invention;

FIG. 3 is a longitudinal section taken through a portion of the embodiment of FIG. 1;

FIG. 4 is a cross-section taken on line 4—4 of FIG. 3;

DESCRIPTION OF THE PREFERRED EMBODIMENTS

Figure 5:
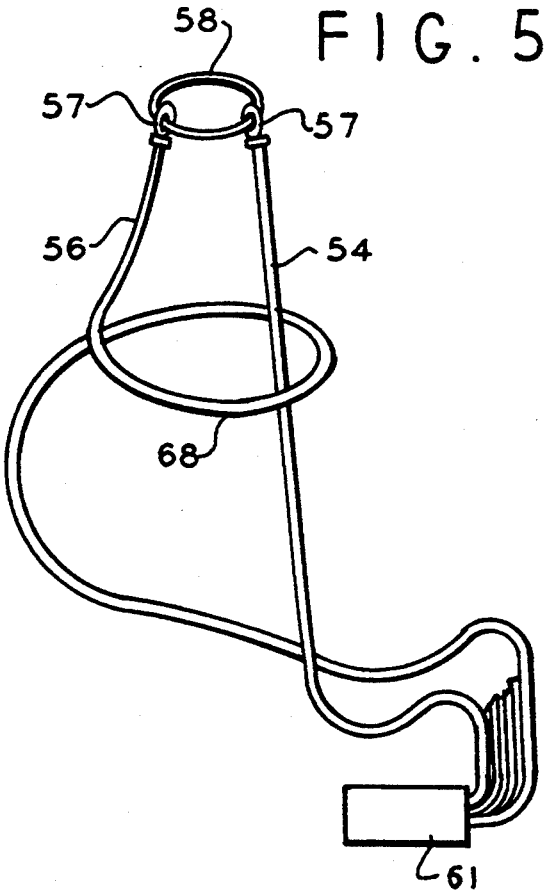
FIG. 5 is an elevational view of a modified form of lighting ornament incorporating the instant invention.

For convenience the invention will be described as applied to a tube of circular cross-section and predetermined length disposed either as a helix of conical or cylindrical configuration or so as to be festooned and which is adapted to contain colored water and to have pockets of air pumped thereinto; it being understood, nevertheless, that without departing from the scope of the invention that subject lighting ornament can utilize a tubular member of any cross-section, which may be arranged in any helical or other configuration and wherein any first fluid, colored or not, may be contained for coaction with a second fluid, whether it be air or otherwise, as long as the second fluid can pass through said first fluid.

With reference to FIG. 1 there is generally shown at 10 a tubular member arranged in the form of a helix of conical configuration adapted to fit over and around a Christmas tree. Tubular member 10 is at least partially filled with a colored liquid, which may be water, and which will be visible when illuminated to provide a colorful and pleasing aesthetic effect when illuminated. Tubular member 10 has a wall 11 capable of transmitting light its entire length.

As shown in FIGS. 1 and 2 a lower end 12 of tubular member 10 is provided with a stopper 14 (FIG. 2) and is suitably mounted within an enclosure 16. Also deployed within enclosure 16 is a motor 18 attached by an axle 19 to a fan A color wheel 22, mounted to be rotated by motor 18 is positioned between end 12 of tube 10 and a light source suitable mounted within enclosure 16 and connected by suitable and conventional means to a source of electrical power and control 29.

An in line fluid pump 26 is disposed within enclosure with its outlet attached in line to tube 10 proximate its end 12 and having an inlet 24 exposed to atmosphere.

Motor 18 and pump 26 are also connected through suitable and conventional means to a source of electrical power and controls.

A suitable and conventional one-way valve 25 may be provided in inlet 24, the valve being adapted to open when pump 26 is energized allowing a fluid, such as air, to be introduced into tube 10. An upper end 27 (FIG. 1) of tube is either open to allow air introduced by pump 26 to be vented from tube 10 or a port 30 is provided proximate end 27 of tube 10. Port 30 may include and be controlled by a suitable and conventional valve 31 to vent air from tube 10. Alternatively a return conduit tube (not shown) may be provided through a suitable and conventional control and motive means from port 30 to inlet 24.

Tubular helical member 10 terminates at second end 27 (FIG. 1) proximate port 30. When light is emitted from wall 11 at end 27, as will be hereinafter explained, it may be allowed to dissipate or it may be directed within an end ornament 32 provided with a plurality of holes 33 which allow the light to shine through ornament 32. End ornament 32 may be a sphere, star, oblique or other appropriate decorative shape made from plastic, aluminum paper or other suitable material.

Illumination of light source 28 causes light emitted thereby to pass through color wheel 22 so that the color or colors carried thereby colors the light. The colored light then impinges upon the end of wall 11 of tube be at its end 14 and is transmitted by wall 11 through its entire length to its end 27. Tube 10 is fabricated from a conventional light transmitting, preferably plastic, material similar to that used in fiber optics.

When pump 26 is energized the air entering tube 10 serves to progressively lift portions of the liquid therein so that very soon there are volumes of liquid 40 (FIGS. 3 and 4) disposed at intervals along the helix from bottom to top, at least partly separated and spaced apart by volumes of air When illuminated the volumes of colored liquid will be highly visible but the volumes representing accumulations of air will not, thus producing a striking and ornamental effect.

A further part of the invention may be the provision in tube 10 of light reflecting flakes or particles 44. As the air moves up the tube 10 the particles 44 as well as the colored liquid will be raised and agitated thus causing the angles of the light reflecting surfaces of the flakes to change thereby modifying the ornamental affect of the device and creating a scintillating affect.

Figure 6:
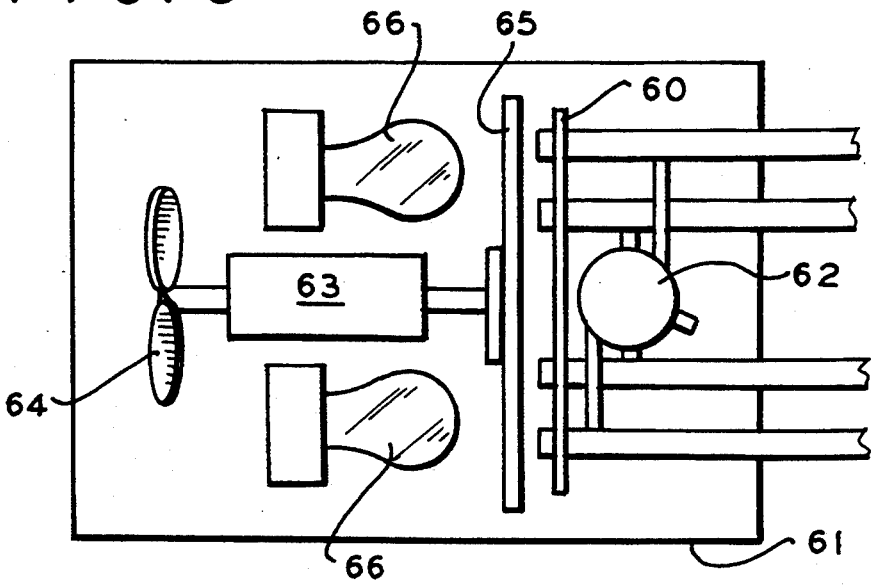
FIG. 6 is an enlarged schematic view of an external light source, coloring means, pump and fan disposed proximate a first end of a plurality of light transmitting tubular members of the modified form of the invention of FIG. 5.

In the modified form of lighting ornament shown in FIGS. 5 and 6, a vertical tubular member 54 and a tubular member 56 which is partly vertical and partly horizontal, are shown hanging, as by means of hooks 57 (FIG. 5) from a supporting ring 58, which may be of metal, plastic or any suitable material, which may be slipped over the top of a Christmas tree or the like and supported by its top branches, thus providing support means from which one or more members 54 and one or more members 56 may be hung. Low ends of all members 54 and 56 extend to a manifold 60 (FIG. 6) disposed within a housing 61 (FIGS. 5 and 6) and which is supplied with liquid from a pump 62 (FIG. 6) which may be of the same kind as pump 26 shown in FIG. 1.

An electrical motor 63, fan 64, color wheel 65 and light source 66 are mounted within housing 61 and are connected to suitable and conventional power and controls as described for comparable components in FIG. 2. These components as well as pump 62 operate in substantially identical manner as described for the same components utilized for the embodiment of FIGS. 1–4.

It will be understood that the members 54 and 56 may be given any desired configuration, and it will be noted that tubular member 56 intermediate its ends defines a loop which may encircle a Christmas tree for example.

The operation of members 54 and 56 is similar to the operation of the helical tube shown in FIG. 1, and suitable inlet and outlet valves may be employed at the bottom and top of members 54 and 56 respectively as described in connection with the helical employment of the invention as shown in FIG.

Figure 7:
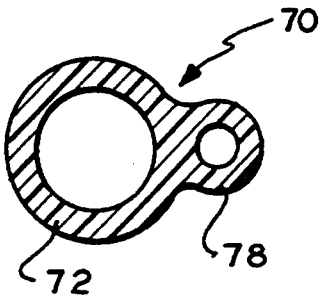
FIG. 7 is a cross-section, similar to that of FIG. 4, but of a tubular member of modified form.
Figure 8:
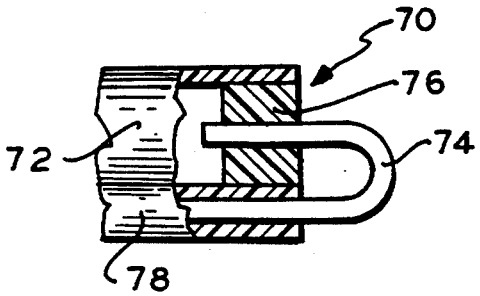
FIG. 8 is a short longitudinal end section of the tubular member of FIG. 7.

In FIGS. 7 and 8 a tubular member 70 of alternative form is shown. Tubular member 70 is similar to tubular member (FIGS. 3 and 4) in that it has a main tubular portion 72 for containing fluids and a tubular conduit 78 which is shown formed proximate portion 72 and at a convenient location on tubular 70. Conduit 78 extends the length of tubular member 70 and is utilized to provide a closed loop for the second fluid that is pumped into the fluid contained in tube 72 as previously mentioned.

As the second fluid passes from whatever fluid is contained in tube 72 it would normally exit into the air or be vented as provided in the embodiment of FIG. 1. In this embodiment a stopper 76 (FIG. 8) is fitted into the free and otherwise open end of tube 72 and is fitted with a loop tube 74 which has one end thereof in stopper 76 and its other end in conduit 78. In this manner fluid passing from the fluid in tube 72 can pass via loop tube 74 into conduit 78 and be returned to the pump (not shown), such as pump 26 or pump 62, provided for circulating said fluid.

Figure 9:
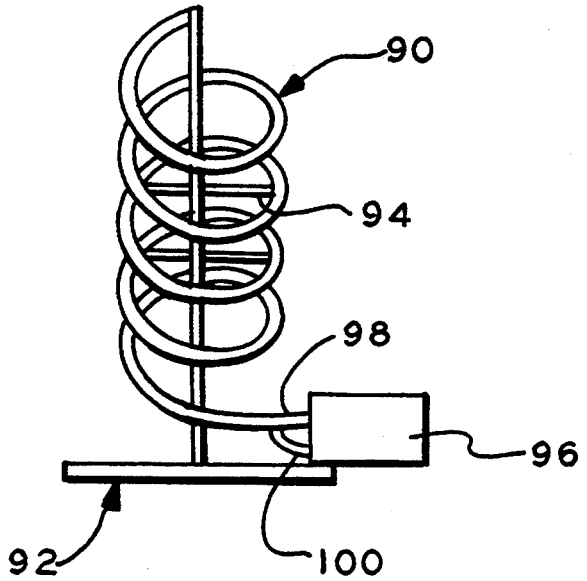
FIG. 9 is an elevational view of another embodiment of the instant invention in the configuration of a helix of cylindrical configuration as an advertising or other ornament.

In FIG. 9 a tubular member 90 is formed as a helix of cylindrical configuration disposed as an ornament which may be used for advertising or similar purposes. A support 92 having branches 94 may be provided to position tubular member 90.

Tubular member 90 may be formed like tubular member 70 with a stopper and loop tube (such as stopper 76 and loop tube 74) at its free end. It is connected at its other end to a pump 96 with the output 98 thereof pumping a second fluid into the fluid tube portion of tubular member 90 and with the inlet 100 thereinto connected to the end of the conduit tube. Otherwise tubular member 90 is illuminated as are the embodiments of FIGS. 1 and 5 and functions like the ornaments described therefor.

Figure 10:
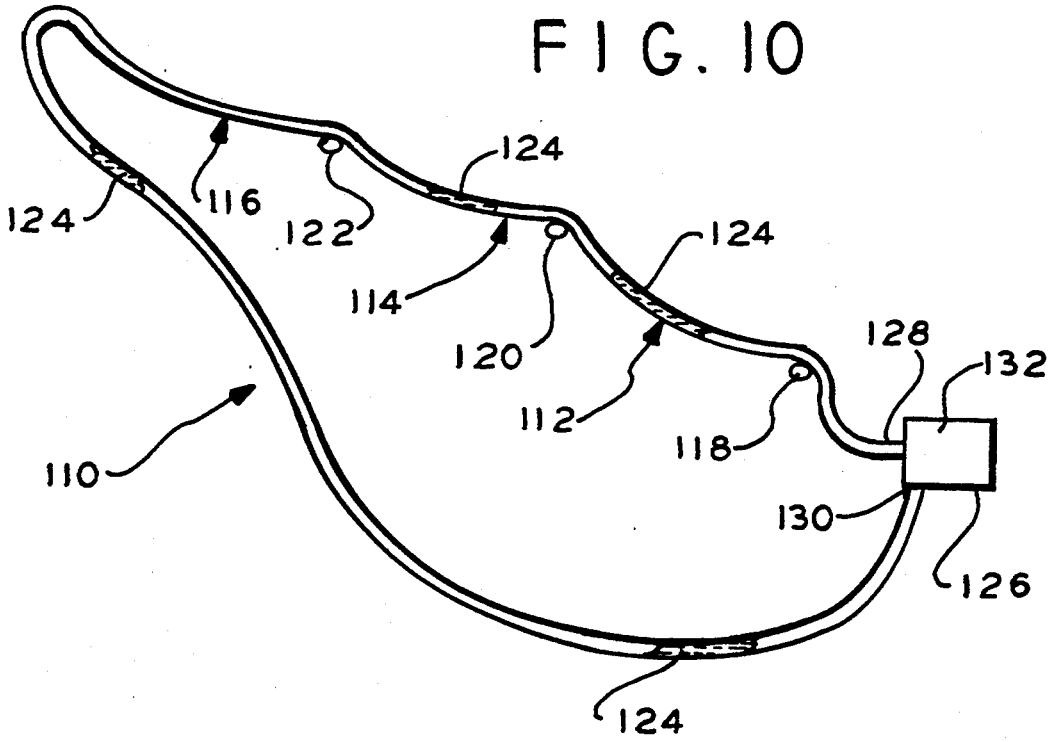
FIG. 10 is an elevational view of yet another embodiment of the invention arranged in a festooned configuration.

In FIG. 10 a tubular member 110 is shown arranged in festooned fashion with sections 112, 114, 116 adapted to be draped over pegs, nails or similar type projection members 118, 120, 122. A first fluid 124 is contained in tubular member 110 and a pump 126 is provided to pump a second fluid, such as air, into fluid 124 through pump outlet 128. An inlet 130 is provided for pump 126 to receive the second fluid after it passes from the free end of tubular member 110. A return conduit 132 may be provided to return the second fluid to pump 126.

Appropriate illuminating means, similar to that provided for the embodiments of FIGS. 1 and 5, are to be disposed in enclosure 132. With pump 126 operating and the illuminating means illuminated the aesthetic affect provided by the embodiment of FIG. 10 is similar to that provided by the other embodiments.

Tubular members 10, 54, 56, 70, 90 and 110 are preferably formed of a light transmitting plastic and extruded in the desired configuration. While they have been shown with circular cross-sections other convenient cross-sections, such as triangular, square or hexagonal may be used for the main fluid containing tube and/or other portions thereof if suitable. Such tubular members are best formed of material which is generally flexible, however, they may also be formed rigid or semi-rigid depending upon the ornamental use intended.

The first fluid, that is the one disposed in the main tubular portion 10 etc., may not only be water or colored water but may be any desired fluid formulation depending upon the aesthetic affect desired. While the second fluid has been generally described as air any other fluid which, once pumped into the first fluid, will bubble through the first fluid to provide the desired appearance is contemplated. Obviously, any suitable pump is appropriate.

From the above description it will thus be seen that novel and improved lighting ornaments have been provided; which lighting ornaments by utilizing a fluid tube which transmits light through its wall for its entire length and may carry a second fluid conduit provides simple and efficient lighting ornaments capable of achieving pleasing and aesthetic affects.

It is understood that although we have shown the preferred forms of our invention that various modifications may be made in the details thereof without departing from the spirit as comprehended by the following claims.

What is claimed is:

1. A lighting ornament; comprising:

(a) translucent tubular member means for containing a volume of fluid and having wall means, forming said tubular member means, from a first end of said tubular member means to a second end of said tubular member means and with said tubular member means being closed at least at said first end;

(b) a volume of liquid disposed within said tubular member means;

(c) light source means disposed proximate an end of said wall means and coacting with said wall means to illuminate said tubular member wall means and the volume of liquid disposed within said tubular member by transmitting light and illuminating the full length of said tubular member wall means;

(d) agitating means for agitating said volume of liquid; and (e) power and control means for operating said light source means and said agitating means.

2. The lighting covenant of claim 1, wherein said agitating means is a fluid pump which pumps a volume of fluid into and through said volume of liquid.

3. The lighting ornament of claim 2, wherein said volume of fluid is air.

4. The lighting ornament of claim 1, including a plurality of particles having light reflective surfaces disposed within said volume of liquid in said tubular member means, said agitating means when activated causing said particles to move thus changing the disposition of said light reflective surfaces thereof.

5. The lighting ornament of claim 4, including coloring means disposed for coaction with said light source means and an end of said tubular member wall means to impart one or more colors to said wall means.

6. The lighting ornament of claim 5, including cooling means disposed for coaction with said light source means to cool same.

7. The lighting ornament of claim 6, including enclosure means for said light source means and said agitating means.

8. The lighting ornament of claim 7, in which said tubular member is in the form of a helix.

9. The lighting ornament of claim 8, wherein:

(a) a valve for admission of air is disposed proximate said first end of said tubular member means;

(b) a port for exhausting air from said tubular member is disposed proximate said second end of said tubular member means; and (c) said agitating means includes pump means connected to said tubular member means to supply air into said tubular member means to form air bubbles therein to agitate said volume of liquid.

10. The lighting ornament of claim 8, in which said volume of liquid is colored and visible when illuminated.

11. The lighting ornament of claim 1, in which said tubular member means is in the form of a helix and adapted to fit over the top of, and around, a Christmas tree or the like.

12. The lighting ornament of claim 1, including termination means disposed at one end of said tubular member means.

13. An ornament; comprising:

(a) a translucent tubular member of predetermined length having an enclosure wall extending said predetermined length between a first end of said tubular member and a second end of said tubular member and being closed at least at said first end and formed to receive and contain a volume of liquid;

(b) said enclosure wall being constructed from materials which transmits and conducts light;

(c) a fluid conduit having a first end and a second end and being carried by said tubular member and extending along said entire predetermined length of said tubular member;

(d) an interconnection connecting one of said ends of said tubular member to an adjacent one of said ends of said fluid conduit;

(e) an agitator for agitating a liquid when disposed within said tubular member;

(f) said other end of said fluid conduit and said other end of said tubular member coacting with said agitator; and (g) a light source disposed in proximity to an end of said tubular member to illuminate the entire length of said tubular member and any liquid disposed therewithin.

14. The ornament of claim 13, wherein said agitator includes a pump means for pumping second fluid into liquid when contained within said tubular member, wherein the second fluid is lighter than the liquid and adapted to move therethrough.

15. The ornament of claim 14 wherein said pump pumps air and said fluid conduit conducts air, which has passed through fluid when contained in said tubular member, back to said pump.

16. The ornament of claim 13, wherein said tubular member and said fluid conduit are integrally formed as an extrusion of plastic material.

17. The ornament of claim 16, wherein said tubular member is arranged as a helix.

18. The ornament of claim 13, wherein said helix is further arranged in a predetermined configuration.

19. The ornament of claim 13, wherein said tubular member is arranged into a plurality of festooned sections.

20. The ornament of claim 13, wherein said tubular member is formed of flexible material to facilitate disposition thereof in various configurations.

* * * * *